US010058220B2

(12) United States Patent
Pollard

(10) Patent No.: US 10,058,220 B2
(45) Date of Patent: Aug. 28, 2018

(54) ADJUSTABLE SHOWER CURTAIN LINER AND REMOVABLE BOTTOM WITH AN INTERCHANGEABLE FRONT PANEL

(71) Applicant: Janet D. Pollard, Pittsburgh, PA (US)

(72) Inventor: Janet D. Pollard, Pittsburgh, PA (US)

( * ) Notice: Subject to any disclaimer, the term of this patent is extended or adjusted under 35 U.S.C. 154(b) by 0 days.

(21) Appl. No.: 15/186,308

(22) Filed: Jun. 17, 2016

(65) Prior Publication Data

US 2017/0027389 A1 Feb. 2, 2017

Related U.S. Application Data

(60) Provisional application No. 62/180,678, filed on Jun. 17, 2015.

(51) Int. Cl.

| | |
|---|---|
| ***A47K 3/38*** | (2006.01) |
| ***A47H 13/04*** | (2006.01) |
| ***A47H 23/06*** | (2006.01) |
| ***A47H 23/01*** | (2006.01) |
| *A47H 23/02* | (2006.01) |
| *A47H 23/00* | (2006.01) |

(52) U.S. Cl.

CPC ..... *A47K 3/38* (2013.01); *A47H 13/04* (2013.01); *A47H 23/01* (2013.01); *A47H 23/06* (2013.01); *A47H 2023/003* (2013.01); *A47H 2023/025* (2013.01)

(58) Field of Classification Search

CPC .... A47K 3/38; A47H 23/00; A47H 2023/003; A47H 2023/025; A47H 23/10; A47H 23/06

USPC ..... 160/DIG. 6, 330, 84.01, 348

See application file for complete search history.

(56) References Cited

U.S. PATENT DOCUMENTS

| | | | | | |
|---|---|---|---|---|---|
| 1,971,712 | A * | 8/1934 | Geller | A47H 13/16 | 160/348 |
| 4,083,395 | A * | 4/1978 | Romano | E06B 3/481 | 160/199 |
| 4,126,172 | A * | 11/1978 | Faragher, Jr. | A47H 23/06 | 160/124 |
| 4,333,187 | A * | 6/1982 | Schuler | A47K 3/38 | 160/330 |
| 5,070,557 | A * | 12/1991 | Vincent | A61F 5/3776 | 128/872 |
| 5,191,922 | A * | 3/1993 | Wade | A47H 13/00 | 160/124 |
| 5,495,628 | A * | 3/1996 | Logan | A47K 3/38 | 160/330 |
| 5,738,159 | A * | 4/1998 | O'Brien | A47H 23/04 | 160/124 |
| 5,974,603 | A * | 11/1999 | Frazier | A47K 3/38 | 160/124 |
| 6,163,899 | A * | 12/2000 | Leonard | A47H 23/06 | 160/330 |

(Continued)

*Primary Examiner* — Janie Loeppke
(74) *Attorney, Agent, or Firm* — Gary P. Topolosky

(57) ABSTRACT

An adjustable shower curtain liner that includes: (a) a plurality of horizontal rows of curtain hook loops; (b) a neutral color for attachment by snaps, buttonholes or Velcro® to a decorative outer panel that go partially to the base of the tub or all the way to the bathroom floor; and (c) a set of lower magnets for keeping the liner close to the tub interior—with one or more strips of perforations that can be easily removed when they become too moldy or unsightly.

12 Claims, 5 Drawing Sheets

(56) References Cited

U.S. PATENT DOCUMENTS

| | | | | |
|---|---|---|---|---|
| 6,488,070 | B1 * | 12/2002 | Cox | A47K 3/38<br>160/84.01 |
| 6,832,642 | B2 * | 12/2004 | Titus | A47H 13/00<br>160/330 |
| 7,523,778 | B2 * | 4/2009 | Roberts | A47H 23/08<br>160/237 |
| 2005/0103452 | A1 * | 5/2005 | Adams | A47K 3/38<br>160/330 |
| 2013/0283519 | A1 * | 10/2013 | Holden | A47H 23/00<br>4/558 |
| 2014/0101842 | A1 * | 4/2014 | Tsibulevskiy | A47K 3/36<br>4/607 |

* cited by examiner

ADJUSTABLE SHOWER CURTAIN LINER AND REMOVABLE BOTTOM WITH AN INTERCHANGEABLE FRONT PANEL

CROSS-REFERENCE TO RELATED APPLICATION

This is a perfection of Provisional Application Ser. No. 62/180,678, filed on Jun. 17, 2015, the disclosure of which is fully incorporated by reference herein.

BACKGROUND OF THE INVENTION

1. Field of the Invention

The present invention relates to shower curtains and several improvements for the same. These improvements can be used individually, in combinations or altogether in one new consumer product.

2. Description of Relevant Art

Shower curtains are well known in the art. Throughout the years, a number of innovations have been developed. The following are representative of some curtain innovations:

U.S. Pat. No. 4,083,395 discloses an acoustic drape that includes a plurality of individual pockets separated from one another by flexible hinges. The pockets contain sound absorbing foam.

U.S. Pat. No. 4,126,172 discloses a shower curtain with two individual curtain portions hung on a common curtain rod by separate curtain rings.

U.S. Pat. No. 4,333,187 discloses a bracket that extends upward and inward from the top of a shower curtain to prevent moisture from passing over and into the bathroom proper.

U.S. Pat. No. 5,070,557 discloses a shower curtain with edge fasteners for attaching to complimentary fasteners on the shower walls.

U.S. Pat. No. 5,191,922 discloses a curtain assembly with a flap that encircles a curtain support rod and lock snaps into place about a support rod.

U.S. Pat. No. 5,495,628 discloses a shower curtain with a selectively raise-able lower portion for cleaning purposes and/or aesthetics.

U.S. Pat. No. 5,738,159 discloses a window curtain having a selectively adjustable appearance.

U.S. Pat. No. 6,163,899 discloses a shower curtain apparatus with a flexible pocket assembly.

U.S. Pat. No. 6,832,642 discloses a window treatment panel having a plurality of loops in rows for horizontally adjusting the panel.

U.S. Pat. No. 7,523,778 discloses a system and method for installing disposable curtains.

While the foregoing prior art indicates a variety of shower curtains with different features, nothing was found which teaches or suggests the improvements of the present invention as shown and described herein.

SUMMARY OF THE INVENTION

The present invention provides a curtain apparatus with: (a) an adjustable back panel with various heights by choosing between a plurality of horizontal rows of curtain hook loops; (b) a neutral color for that back panel to which can be attached (by snaps, Velcro® or the like) decorative outer panels that go partially to the base of the tub or all the way to the bathroom floor, at the installer's discretion; and (c) a lower magnet joiner for keeping the shower curtain close to the tub interior—with one or more strips of perforations below the magnetic holds to remove the lowermost sections when they become too moldy or unsightly.

It is therefore an object of the present invention to provide a new and improved shower curtain apparatus which has all of the advantages of the prior art and none of the disadvantages.

It is another object of the present invention to provide a new and improved shower curtain apparatus which may be easily and efficiently manufactured and marketed.

It is a further object of the present invention to provide a new and improved shower curtain apparatus which is of durable and reliable construction.

An even further object of the present invention is to provide a new and improved shower curtain apparatus which is susceptible of a low cost of manufacture with regard to both materials and labor, and which accordingly is then susceptible of low prices of sale to the consuming public, thereby making such shower curtain apparatus available to the buying public.

Still another object of the present invention is to provide a new and improved shower curtain apparatus which permits changing a decorative design without replacing the shower curtain.

BRIEF DESCRIPTION OF THE DRAWINGS

The invention will be better understood with the following detailed description made with reference to the accompanying drawings in which.

At the base (or towards the bottom end) of curtain 10, there is a set (at least 3) of spaced magnets 20 below which there are added a plurality, i.e., one or more, of perforation rows 22, 24 for tearing away unsightly, spent lower curtain edges when the mold build up on this lower edge warrants a full strip removal, while still keeping the curtain proper duly hung (removal of the lowest most strip being made possible while the curtain still hangs from the rod). The original row of tub-hugging magnets M extends below the lowest most row of perforations. Note again, that only two such rows of perforations are depicted but it is to be understood that three or more such rows may be included in the alternative.

Figure 3:
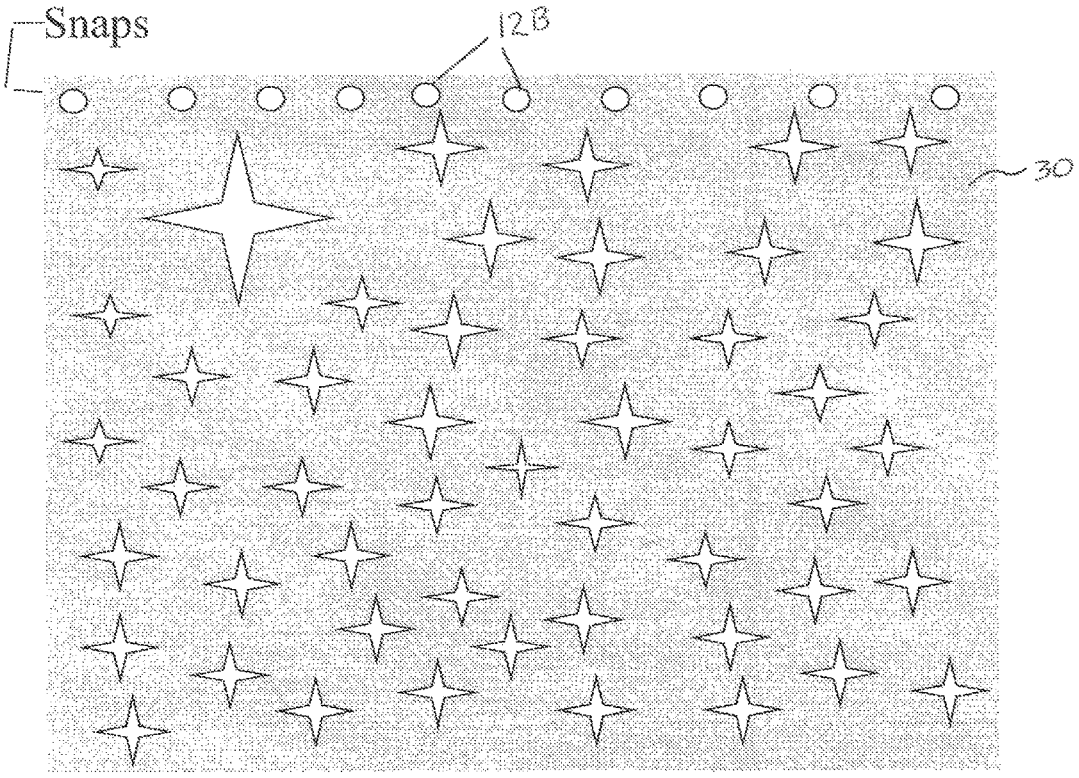
Figure 4:
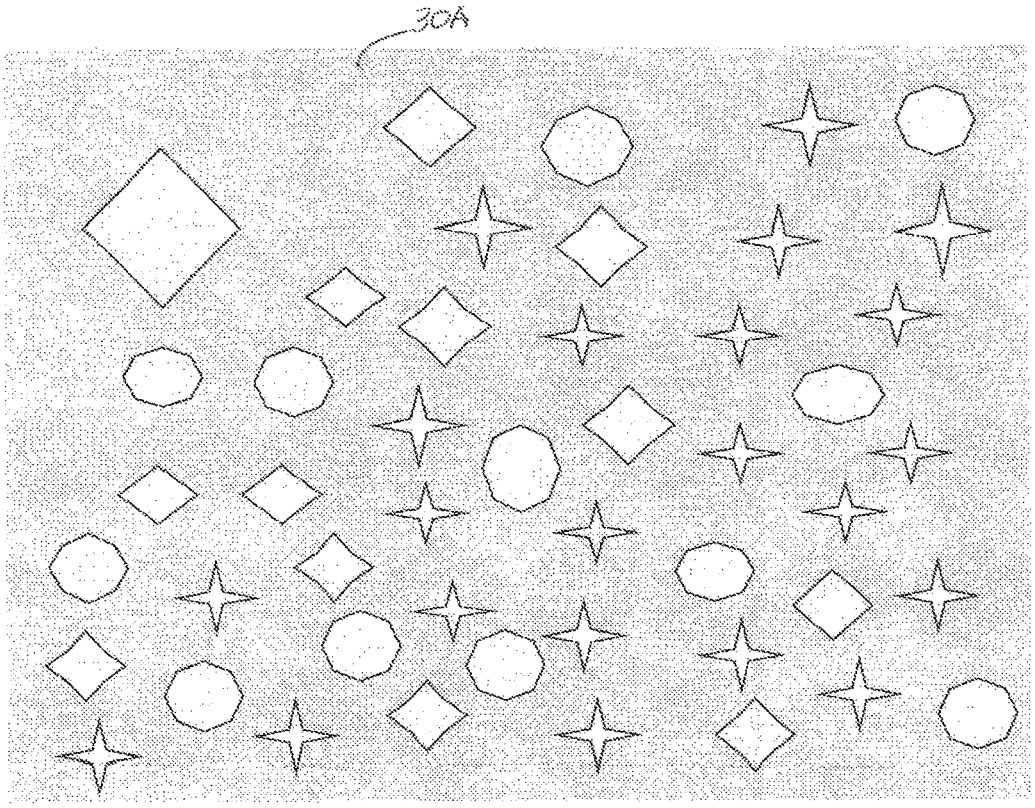
Figure 5:
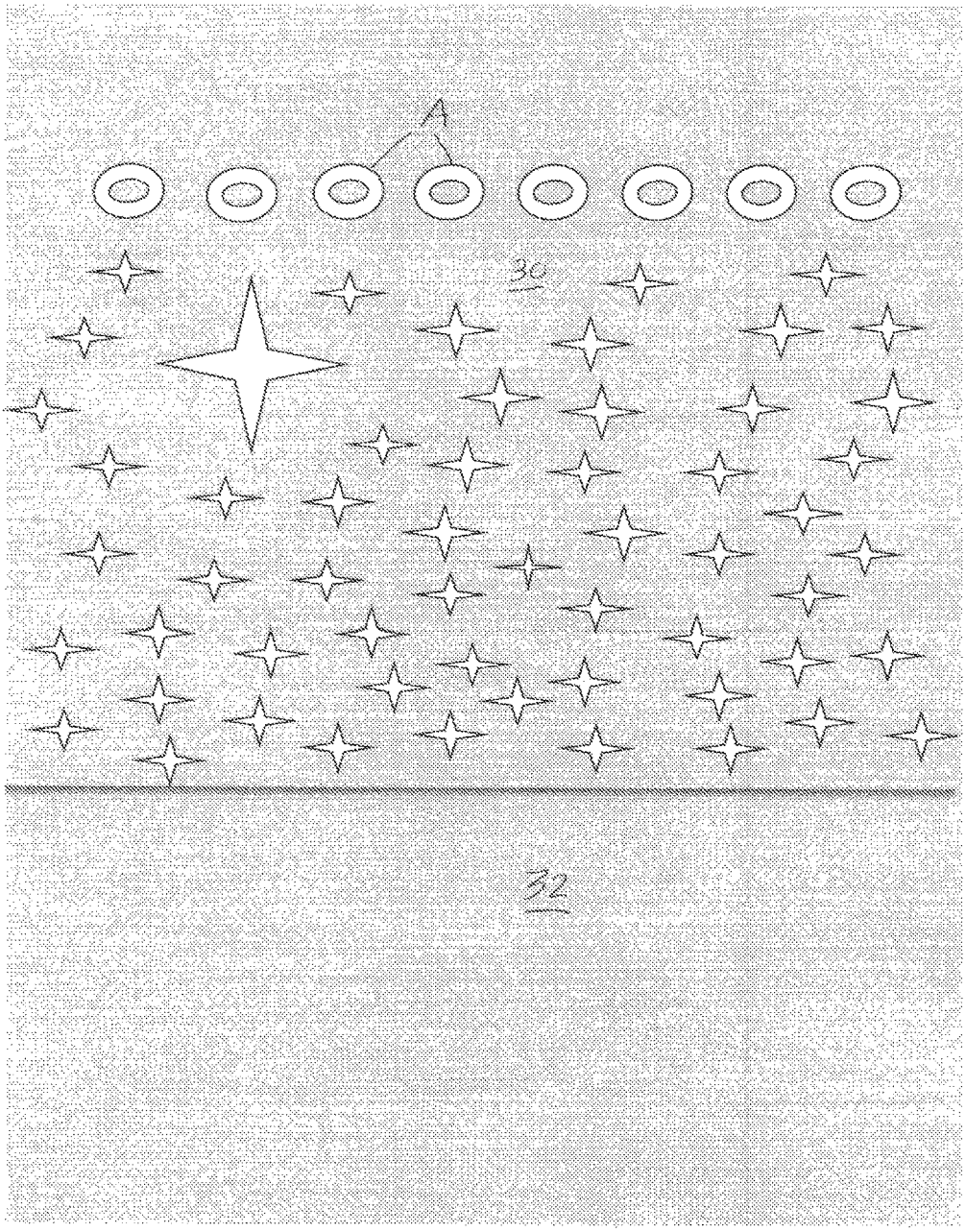

FIG. 3 is a front plan view showing a first (full length) outer curtain 30 that can attach to the top row of inner curtain snaps 12B for providing the decorator/home owner with a first look/appearance of the outer star pattern over a neutrally colored under-liner;

FIG. 4 is a front plan view showing a second outer curtain 30A, with its own (or second) design/pattern that can be used to REPLACE the design of outer curtain 30 in FIG. 3 when the homeowner desires a second, different look from the first; and FIG. 5 is a front plan view showing the outer curtain 30 of FIG. 3 but in only a half-wall size so that a portion of the neutral under-liner 32 purposefully hangs well below its decorative outer curtain (intentionally half-sized).

DESCRIPTION OF PREFERRED EMBODIMENTS

With reference to the drawings, a new and improved shower curtain apparatus embodying the principles and concepts of the present invention will be described.

Figure 1:
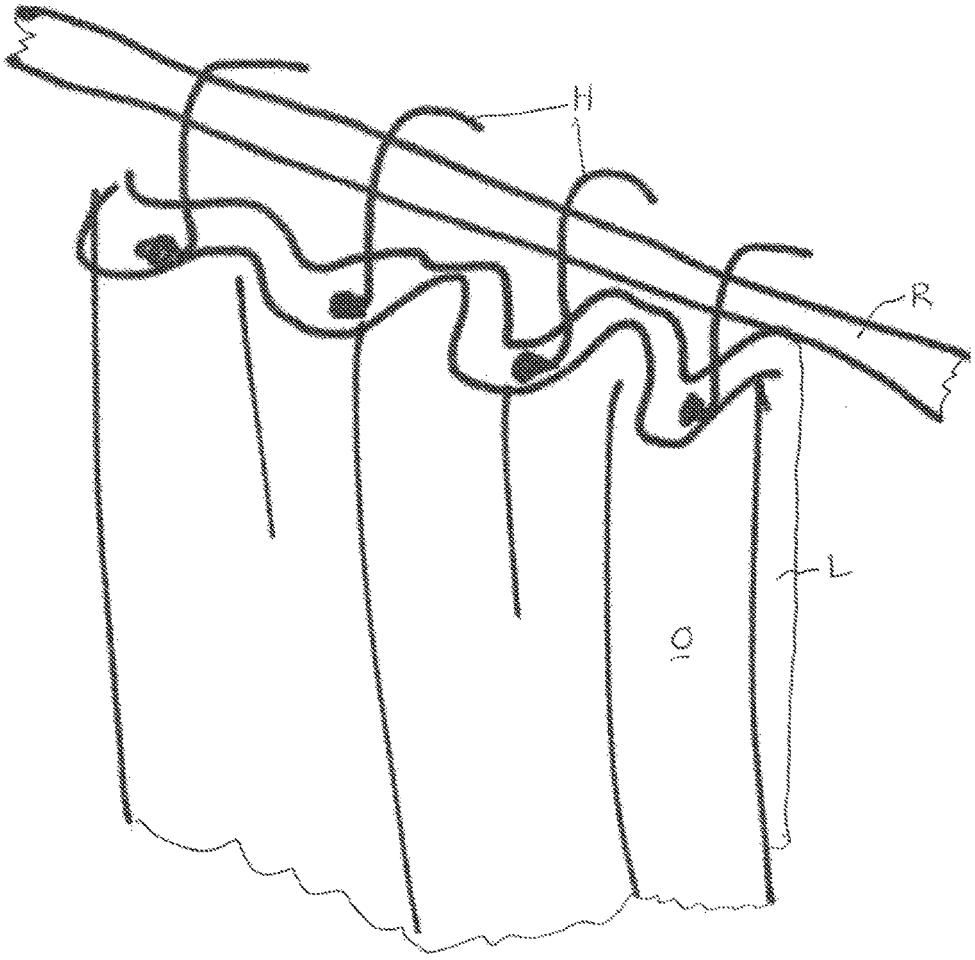
FIG. 1 is a perspective view showing a typical shower curtain arrangement with an inner liner L and outermost decorative curtain O suspended from one set of spaced hooks H connected to a horizontally connected, shower curtain rod R.
Figure 2:
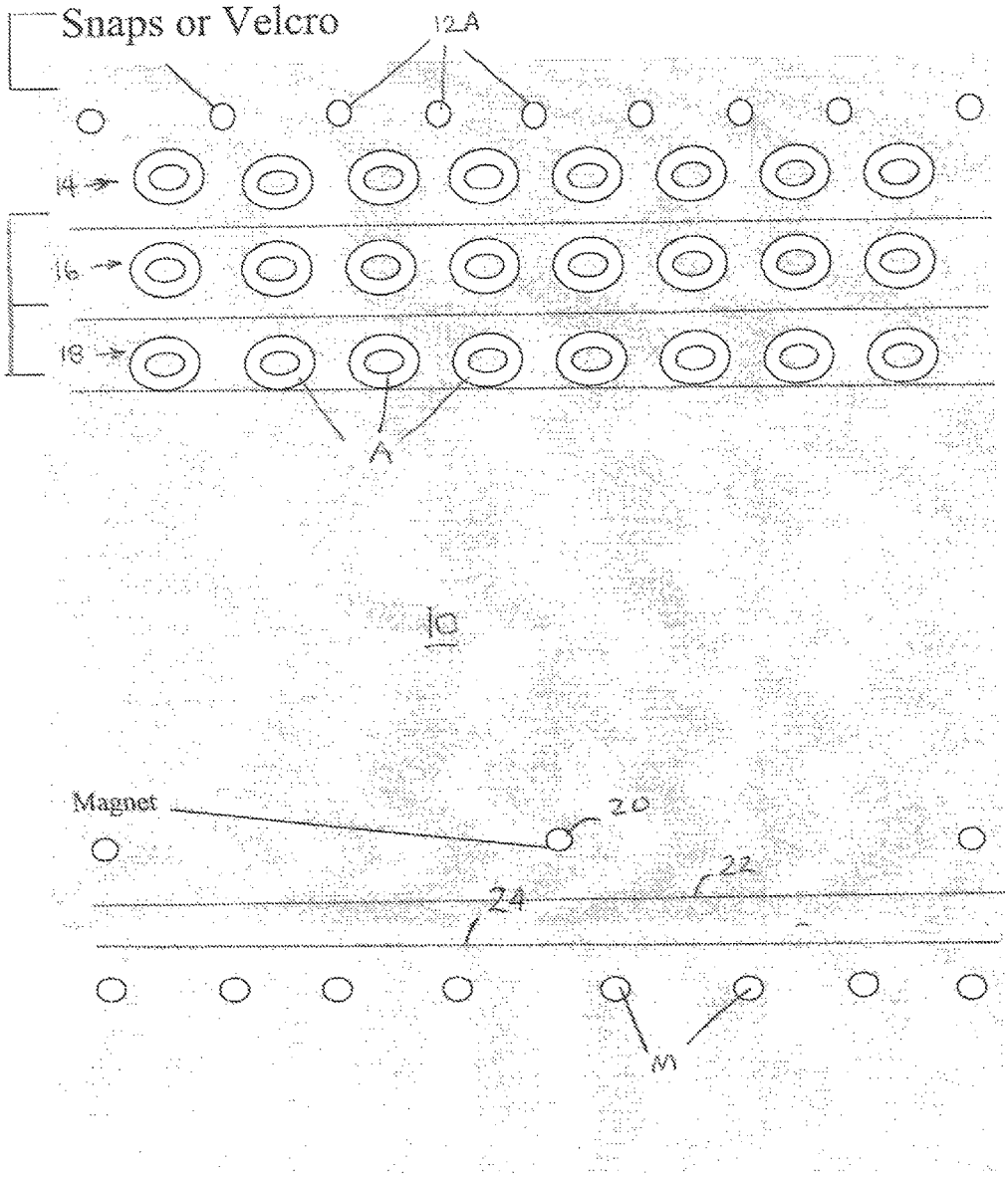
FIG. 2 is a front plan view of one embodiment of adjustable inner shower curtain 10 according to this invention showing an uppermost row of snaps 12A (or Velcro® strips in the alternative) to which will attach an exchangeable, variable decorative outer curtain (not shown). Below that row of connector snaps/Velcro® 12, there is positioned a plurality, preferably three sets, of horizontally extending, connector hook loops (or apertures A) for making a physical choice on where to insert the curtain hooks depending on the length up/down the shower stall wall and/or tub base that the installer wants to achieve for his/her preferred aesthetic looks. Particularly, there is a first, uppermost row 14 of apertures A, a middle row 16 and lower row 18. Note, however, that there can be at least two such rows, or more than three (four or more) in the alternative.

Turning to FIGS. 2-5, there is shown an exemplary embodiment with various aspects of these shower curtain improvements, FIG. 2 showing all of them in one improved product. FIGS. 3 and 4 show the interchangeability of two different outer curtain designs 30 and 30A while FIG. 5 shows yet another variation using only a half-sized outer curtain 30 so that some of the neutrally-colored under-liner 32 extends below this half-shell. Note that this invention makes it quite easy to change outer shells, during different holiday seasons or to reflect different styling motifs. The main under-liner need not be taken down but rather left hooked onto the upper curtain rod between style transfers.

The components of the shower curtain apparatus of the invention can be made from inexpensive and durable plastic materials.

While the present invention has been shown in the drawings and described with particularity and detail herein, what is presently deemed to be the most practical and preferred embodiment(s) of this invention will be apparent to those of ordinary skill in the art upon reading the accompanying claims. It should be further understood that many modifications thereof may be made without departing from the principles and concepts set forth herein, including, but not limited to, variations in size, materials, shape, form, function and manner of operation, assembly and use.

The shower curtains of this invention can be a one whole panel or two separate (split) panels. The back panel is adjustable but has a plurality (i.e., three or more) rows of apertures A through which curtain hooks may be installed depending on the total length of curtain hanging desired. Note that the second and third rows of hook apertures A can be folded up and onto themselves for overall curtain hanging VERTICAL adjustability.

For a second aspect of these curtain rod improvements, note how the variation shown in FIG. 2 depicts a shower curtain with an uppermost (or first) row of snaps 12A (or Velcro® strips). These attachments would be used to strategically connect a first decorative panel 30 over the under-liner (not shown in this view) and then subsequently REPLACE that first liner, while the under-liner still hangs from its rod, whenever one tires of the first design or otherwise wants to replace outer panel B for outer panel A.

The back panel 32 is always a solid neutral color. The back panel and front panel will have snaps 12A and 12B strategically placed on the very top of the first row of the back panel and at the very top of the front panel to allow for front (or outer) panel interchangeability.

Yet another novel feature herein is the relative adjustability of the back panel's vertical hanging length. It purposefully includes three (or more) rows of hanging hook holes/apertures A. The bottom two rows can be folded up and down to allow for more flexible vertical adjustability.

Toward the bottom of FIG. 2, there is shown multiple (in this case, three) spaced magnets, intended to hold the shower curtain in place and against the main tub interior. Yet another improvement/aspect of this invention is to supply the under-liner with at least one and preferably more rows of perforated strips 22, 24 beneath the row of three or more holding magnets 20. It is the intention of the inventor that should the lower edge of the under-curtain get too dirty (moldy or otherwise), it can be simply torn away and THE next lowermost edge be used. Should the overall length of this under-liner need to be physically adjusted for consistent hang-down, the uppermost hole hooks can be shifted to one or the other hanging hole rows seen at the top of FIG. 2. If there is no need to adjust overall curtain length, the lowest most under-liner edge can be removed while the curtain proper still hangs from its uppermost, horizontal hanging rod.

Referring now to FIG. 3 through 5, the front (or outer) panel over the back (or under-liner) panel can be replaced to change the look of the shower curtain with snaps that at the very top of both the front and back panels. A front panel 32 that reaches down only half way is yet another design feature variation shown in FIG. 5.

For marketing and flexibility of packaging/sales, it is desired that each shower curtain under-liner (back panel) be combined with at least TWO complementary front or outer) panels having different designs/patterns imprinted thereon.

The foregoing drawings and discussion are illustrative of some specific embodiments of the present invention but are not meant to be limitations upon the practice thereof. In view of the teaching presented herein, other modifications and variations of the present invention will be apparent to those of skill in the art.

What is claimed is:

1. An improved shower curtain comprising:

a single liner panel having a top horizontal edge and a bottom horizontal edge, said top edge of said single panel including a plurality of rows of spaced, horizontally extending apertures, each individual row of spaced apertures being designed for the placement of multiple shower rod hanging hooks, one hook per aperture, in order to hang the single panel from the row of horizontal apertures onto a curtain rod, said single panel having a first row of spaced apertures extending above and parallel to a second row of apertures directly beneath, the apertures of the first row and the second row aligning vertically with one another to place a hanging hook into the vertically aligned apertures of two or more rows for changing vertical length of the single panel, said bottom edge designed to contact with a sidewall of the tub or a floor of the shower if no tub, said bottom edge having a plurality of horizontally extending, perforation rows stacked one above the other, said perforation rows being designed to be purposefully torn away at a bottom of the preceding row, one row at a time, for making a new bottom row of the single liner panel.

2. The improved shower curtain of claim 1, which includes three parallel rows of apertures, with one parallel row stacked above the parallel row directly beneath.

3. The improved shower curtain of claim 1, which further includes a row of outer snaps for attaching an outer cover panel to the liner panel.

4. The improved shower curtain of claim 1, which further includes a row of buttonholes for attaching an outer cover panel to the liner panel.

5. The improved shower curtain of claim 1, which further includes a row of hook and loop fastener strips for attaching an outer cover panel to the liner panel.

6. A shower curtain liner for hanging by hooks onto a horizontal curtain rod, said curtain liner including a single downwardly extending panel, said panel having a top horizontal edge and a bottom horizontal edge that is designed to contact with or rest directly adjacent a floor of the shower, the improvement comprising:

(i) said top edge including at least three stacked, parallel rows of apertures through which the hanging hooks may be inserted with at least a first row of apertures extending horizontally and parallel to a second row of apertures directly beneath, the apertures of the first row and the second row aligning vertically with one another;

(ii) said bottom edge including a plurality of perforation rows, said perforation rows being stacked one above the other and designed to be purposefully torn away along a bottom preceding row, one row at a time, for making a new bottom for the curtain liner; and (iii) means for attaching an outer cover to an outer surface of the single downwardly extending panel at or near its top edge.

7. The shower curtain liner of claim 6 wherein the outer cover attaching means includes a row of outer snaps.

8. The shower curtain liner of claim 6 wherein the outer cover attaching means includes a row of buttonholes.

9. The shower curtain liner of claim 6 wherein the outer cover attaching means includes a row of hook and loop fastener strips.

10. The shower curtain liner of claim 6 wherein unused rows of apertures in the improvement can be folded under one another for changing vertical length of the shower curtain.

11. The shower curtain liner of claim 6 wherein the improvement includes three or more parallel perforation rows, with one parallel perforation row stacked above the parallel row directly beneath.

12. The shower curtain liner of claim 6 wherein each parallel perforation row includes a plurality of magnets.

* * * * *